US009717947B2

(12) United States Patent
Lin

(10) Patent No.: US 9,717,947 B2
(45) Date of Patent: Aug. 1, 2017

(54) CLIMBING EXERCISER MACHINE WITH ADJUSTABLE INCLINATION

(71) Applicant: Rexon Industrial Corp., Ltd., Taichung (TW)

(72) Inventor: Hung Chi Lin, Taichung (TW)

(73) Assignee: REXON INDUSTRIAL CORP., LTD., Taichung (TW)

( * ) Notice: Subject to any disclaimer, the term of this patent is extended or adjusted under 35 U.S.C. 154(b) by 0 days.

(21) Appl. No.: 15/156,827

(22) Filed: May 17, 2016

(65) Prior Publication Data

US 2016/0339295 A1 Nov. 24, 2016

(30) Foreign Application Priority Data

May 19, 2015 (TW) ..... 104115918 A

(51) Int. Cl.

| | |
|---|---|
| ***A63B 22/04*** | (2006.01) |
| ***A63B 23/04*** | (2006.01) |
| ***A63B 23/035*** | (2006.01) |
| ***A63B 21/00*** | (2006.01) |
| ***A63B 23/12*** | (2006.01) |

(52) U.S. Cl.

CPC ..... *A63B 23/0458* (2013.01); *A63B 21/4035* (2015.10); *A63B 22/04* (2013.01); *A63B 23/03533* (2013.01); *A63B 23/1209* (2013.01)

(58) Field of Classification Search

USPC ..... 482/51–57

See application file for complete search history.

(56) References Cited

U.S. PATENT DOCUMENTS

| | | | | |
|---|---|---|---|---|
| 6,440,042 | B2 * | 8/2002 | Eschenbach | A63B 22/001 482/51 |
| 6,905,442 | B1 * | 6/2005 | Lee | A63B 22/001 482/51 |
| 7,037,242 | B2 * | 5/2006 | Lo | A63B 22/001 482/52 |
| 7,462,135 | B2 * | 12/2008 | Lo | A63B 22/001 482/52 |
| 7,918,766 | B2 * | 4/2011 | Lu | A63B 22/001 482/51 |
| 8,113,995 | B1 * | 2/2012 | Hsu | A63B 22/001 482/51 |

(Continued)

*Primary Examiner* — Stephen Crow

(74) *Attorney, Agent, or Firm* — Bacon & Thomas, PLLC

(57) ABSTRACT

A climbing exercise machine with adjustable inclination includes a frame, an exercising unit including pair of arm members respectively pivotally mounted to the frame, a pedal unit including a pair of pedal shafts respectively pivotally connected to the arm members, a damper including a rotatable wheel with an axle and adapted for providing damping to the pedal unit, a guide unit including a pair of cranks respectively fixedly connected to opposite ends of the axle of the rotatable wheel and respectively pivotally connected to the pedal shafts, a pair of rockers respectively pivotally connected to the cranks and a pair of links respectively pivotally connected to the rockers, and an adjusting unit mounted to the frame and adapted for driving the links to adjust the distance between a rear pivoting portion of each rocker and the frame and to achieve adjustment of the inclination of the climbing exercise machine.

3 Claims, 6 Drawing Sheets

(56) References Cited

U.S. PATENT DOCUMENTS

| | | | | |
|---|---|---|---|---|
| 8,210,993 | B2 * | 7/2012 | Lee | A63B 21/225 482/52 |
| 8,376,913 | B2 * | 2/2013 | Lee | A63B 22/001 482/52 |
| 8,465,398 | B2 * | 6/2013 | Lee | A63B 21/225 482/52 |
| 9,550,089 | B2 * | 1/2017 | Tseng | A63B 21/225 |
| 2006/0250753 | A1 * | 11/2006 | Lui | A63B 22/0015 361/600 |
| 2007/0042871 | A1 * | 2/2007 | Wu | A63B 22/001 482/52 |

* cited by examiner

CLIMBING EXERCISER MACHINE WITH ADJUSTABLE INCLINATION

BACKGROUND OF THE INVENTION

1. Field of the Invention

The present invention relates to sports equipment technology and more particularly, to a climbing exercise machine with adjustable inclination.

2. Description of the Related Art

A climbing exercise machine (Taiwan Patent 355379) is known comprising a frame, a pivot holder located at a front side of the frame, a pair of rotating rods pivotally connected to the pivot holder, a pin mounted at each rotating rod, and a tilt adjustment rack with adjustment holes for selectively receiving the pins at the rotating rods. The arrangement allows for adjustment of the inclination of the machine's pedals. However, when going to adjust the inclination, the user needs to detach the pins, and then to move the tilt adjustment rack relative to the rotating rods, and then to mount the pins in position.

While such a design of climbing exercise machine allows adjustment of the inclination, if the user wishes to adjust the inclination, the user needs to lift the front end of the machine from the floor, or perform the adjustment when the machine is collapsed. Thus, the adjustment of the inclination of the pedals of this design of climbing exercise machine is complicated and inconvenient.

SUMMARY OF THE INVENTION

The present invention has been accomplished under the circumstances in view. It is the main object of the present invention to provide a climbing exercise machine with adjustable inclination, which facilitates the adjustment of inclination.

To achieve this and other objects of the present invention, a climbing exercise machine comprises a climbing exercise machine comprises a frame, an exercising unit, a pedal unit, a damper, a guide unit, and an adjusting unit. The frame comprises a base, and a support fixedly mounted at the base. The exercising unit comprises a pair of arm members respectively pivotally mounted to the support of the frame and alternatively movable back and forth relative to the frame. Each arm member comprises a pivot-connection portion located at a top end thereof and pivotally connected to the support, and a swinging portion located at an opposing bottom end thereof. The pedal unit comprises a pair of pedal shafts respectively pivotally connected to the arm members. Each pedal shaft comprises a front end portion located at a front end thereof and pivotally connected to the swinging portion of one respective arm member, and a rear end portion located at an opposite end thereof. The damper is adapted for imparting damping to the pedal shafts, and comprises a rotatable wheel. The rotatable wheel comprises an axle pivotally connected to the frame. The guide unit comprises a pair of cranks respectively fixedly connected to two opposite ends of the axle of the rotatable wheel and adapted for driving the rotatable wheel to rotate, a pair of rockers respectively pivotally connected to the cranks, and a pair of links respectively pivotally connected to the rockers. Each rocker comprises a middle pivoting portion located at a middle part thereof and pivotally connected to one respective crank, a rear pivoting portion located at a rear end thereof and pivotally connected to the rear end portion of one respective pedal shaft of the pedal unit, and a front pivoting portion located at an opposing front end thereof and pivotally connected to one respective link. Each link has one end thereof pivotally connected to the front pivoting portion of one respective rocker, and an opposite end thereof terminating in a constrained end portion. The adjusting unit is mounted at the frame, and operable to move the constrained end portions of the links relative to the support to further adjust the distance between the rear pivoting portions of the rockers and the base.

Thus, the invention uses the adjusting unit to move the constrained end portions of the links relative to the support of the base, achieving adjustment of the distance between the rear pivoting portions of each rockers and the base of the frame, and thus, the inclination of the pedal shafts is relatively adjusted. The climbing exercise machine of the invention has a simple structure, and allows easy adjustment of the inclination in a stepless manner.

Other advantages and features of the present invention will be fully understood by reference to the following specification in conjunction with the accompanying drawings, in which like reference signs denote like components of structure.

DETAILED DESCRIPTION OF THE INVENTION

Figure 1:
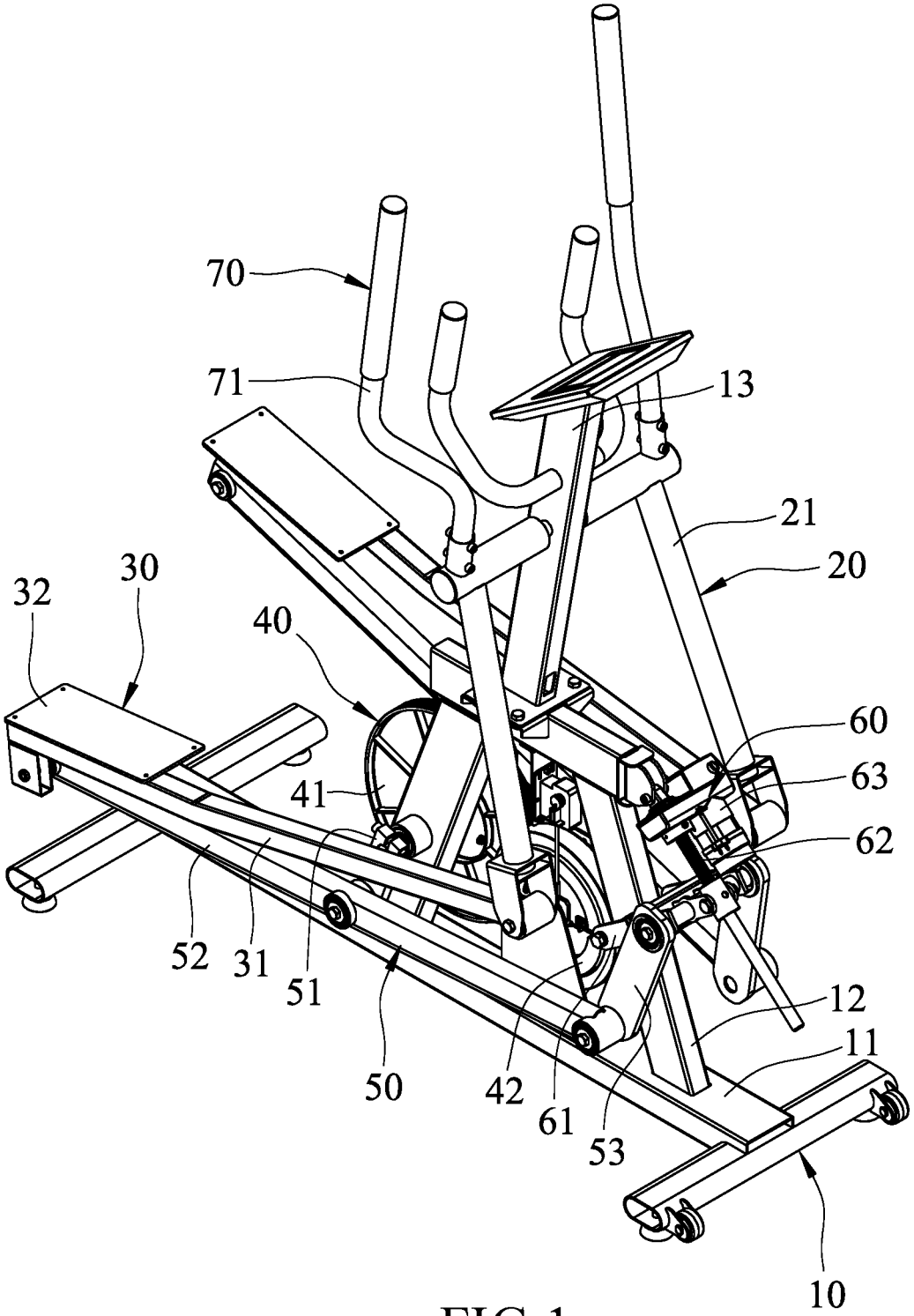
FIG. 1 is perspective view of a climbing exercise machine with adjustable inclination in accordance with the present invention.
Figure 2:
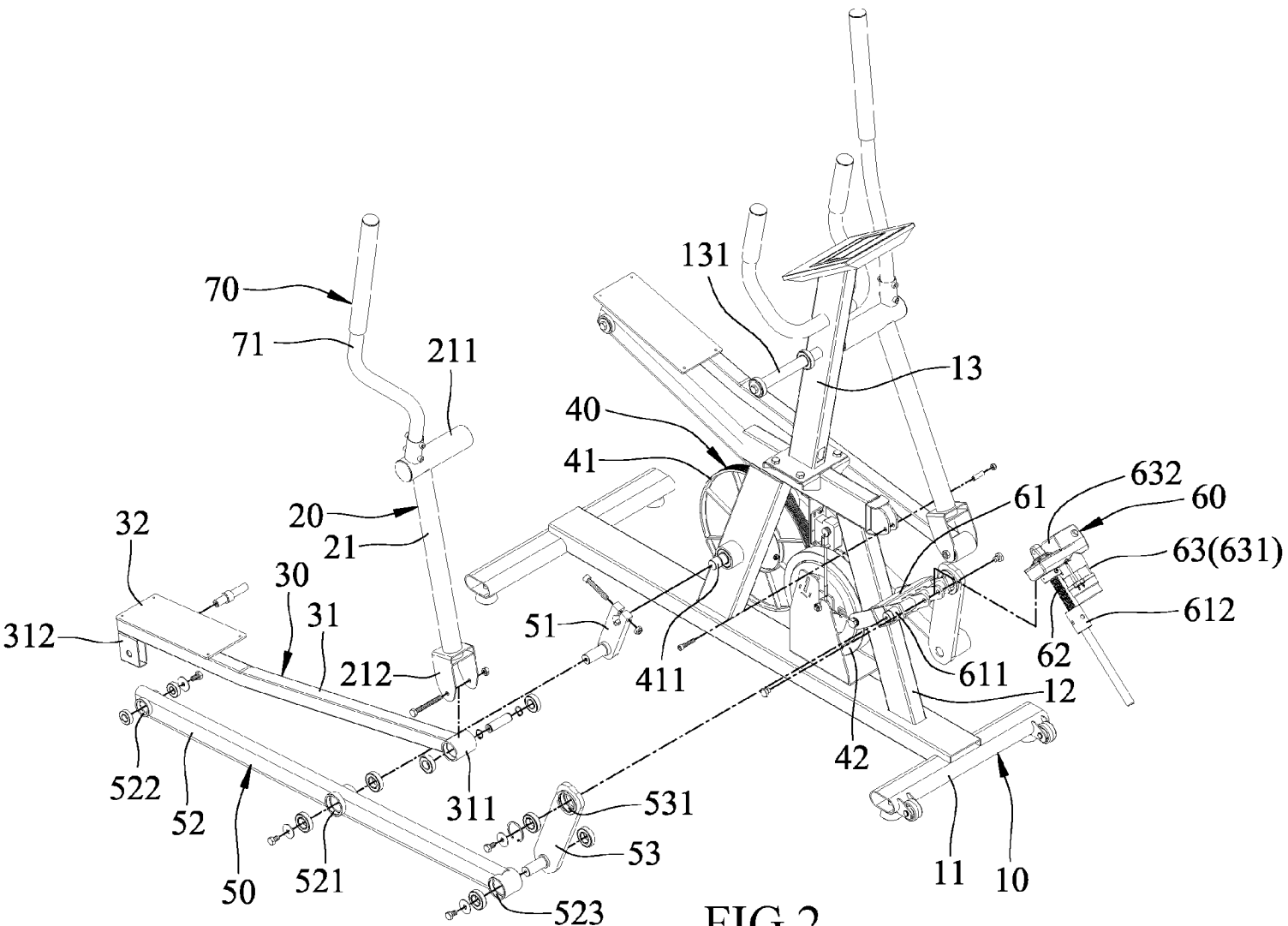
FIG. 2 is a partial exploded perspective view of the climbing exercise machine with adjustable inclination in accordance with the present invention.
Figure 3:
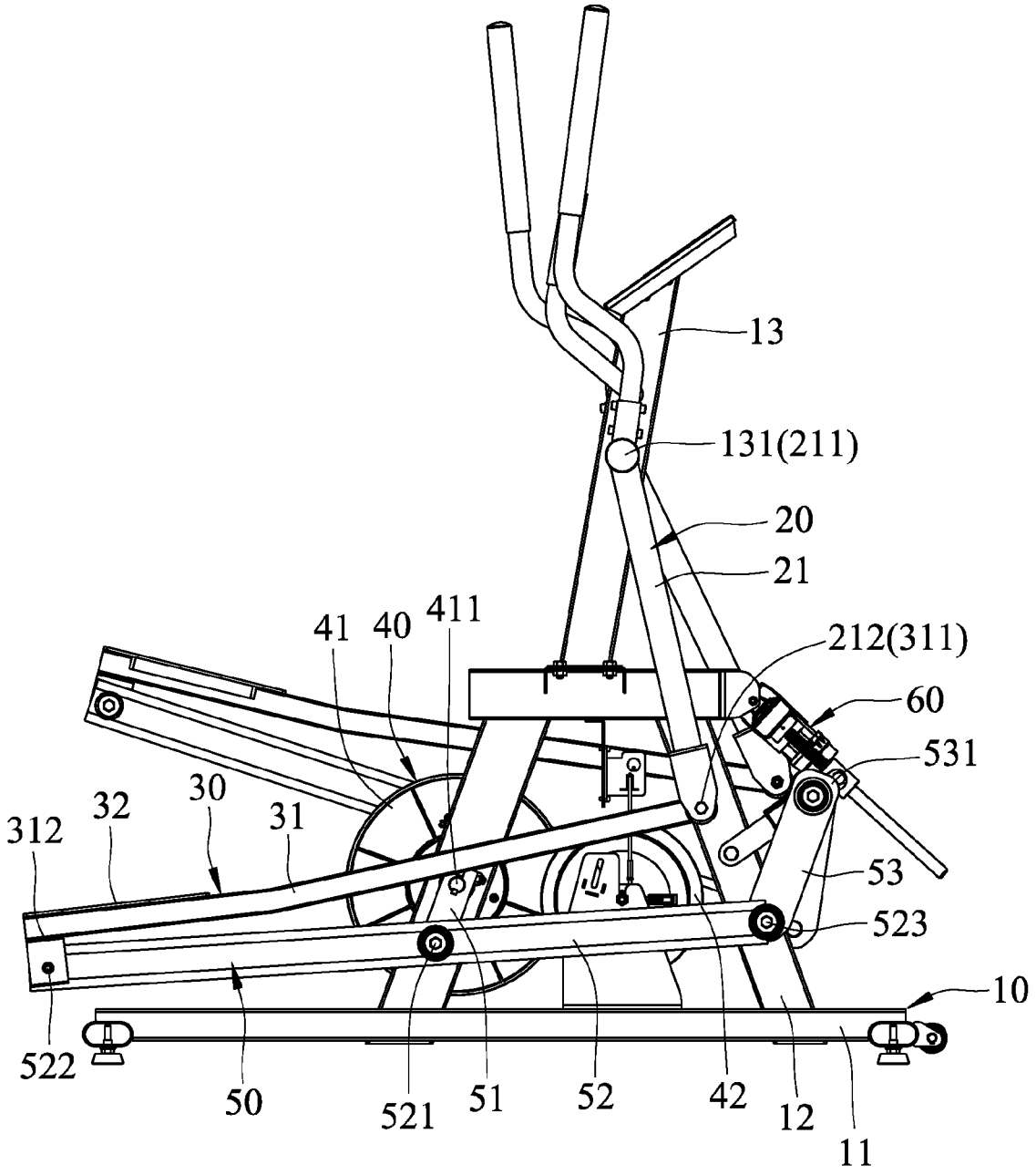
FIG. 3 is a front plain assembly view of the climbing exercise machine with adjustable inclination in accordance with the present invention.

Referring to FIGS. 1, 2 and 3, a climbing exercise machine with adjustable inclination in accordance with the present invention is shown. The climbing exercise machine comprises a frame 10, an exercising unit 20, a pedal unit 30, a damper 40, a guide unit 50, an adjusting unit 60, and a handlebar unit 70.

The frame 10 comprises a base 11, and a support 12 fixedly mounted to a front side of the base 11. The support 12 comprises an upright post 13 located at a top side thereof, and a transverse axle 131 fixedly and transversely extending across the upright post 13 near a top end thereof.

The exercising unit 20 comprises a pair of arm members 21 respectively pivotally connected to two opposite ends of the transverse axle 131 of the frame 10 and alternatively turnable back and forth about the transverse axle 131. Each arm member 21 comprises a pivot-connection portion 211 located at a top end thereof and pivotally connected to the respective one end of the transverse axle 131, and a swinging portion 212 located at an opposing bottom end thereof.

The pedal unit 30 comprises a pair of pedal shafts 31 respectively pivotally connected to the arm members 21 of the exercising unit 20, and a pair of pedals 32 respectively fixedly supported on the respective pedal shafts 31. Each pedal shaft 31 comprises a front end portion 311 pivotally connected to the swinging portion 212 of one respective arm member 21, and an opposing rear end portion 312. The pedals 32 are respectively fixedly mounted on the rear end portions 312 of the respective pedal shafts 31.

The damper 40 is adapted for imparting a damping resistance to the pedal shafts 31. The damper 40 comprises a rotatable wheel 41 pivotally mounted in the support 12, and a damping wheel 42 pivotally mounted in the support 12 and rotatable by the rotating wheel 41. The rotatable wheel 41 has an axle 411 axially located at the center and pivotally mounted in the support 12.

The guide unit 50 comprises a pair of cranks 51 respectively fixedly connected to two opposite ends of the axle 411 of the rotatable wheel 41 in reversed directions and adapted for driving the rotatable wheel 41 to rotate, a pair of rockers 52 respectively pivotally connected to the cranks 51, and a pair of links 53 respectively pivotally connected to the rockers 52. Each rocker 52 comprises a middle pivoting portion 521 located at a middle part thereof and pivotally connected to one respective crank 51, a rear pivoting portion 522 located at a rear end thereof and pivotally connected to the rear end portion 312 of one respective pedal shaft 31 of the pedal unit 30, and a front pivoting portion 523 located at an opposing front end thereof and pivotally connected to one respective link 53. Each link 53 has one end thereof pivotally connected to the front pivoting portion 523 of one respective rocker 52, and an opposite end thereof terminating in a constrained end portion 531.

Figure 4:
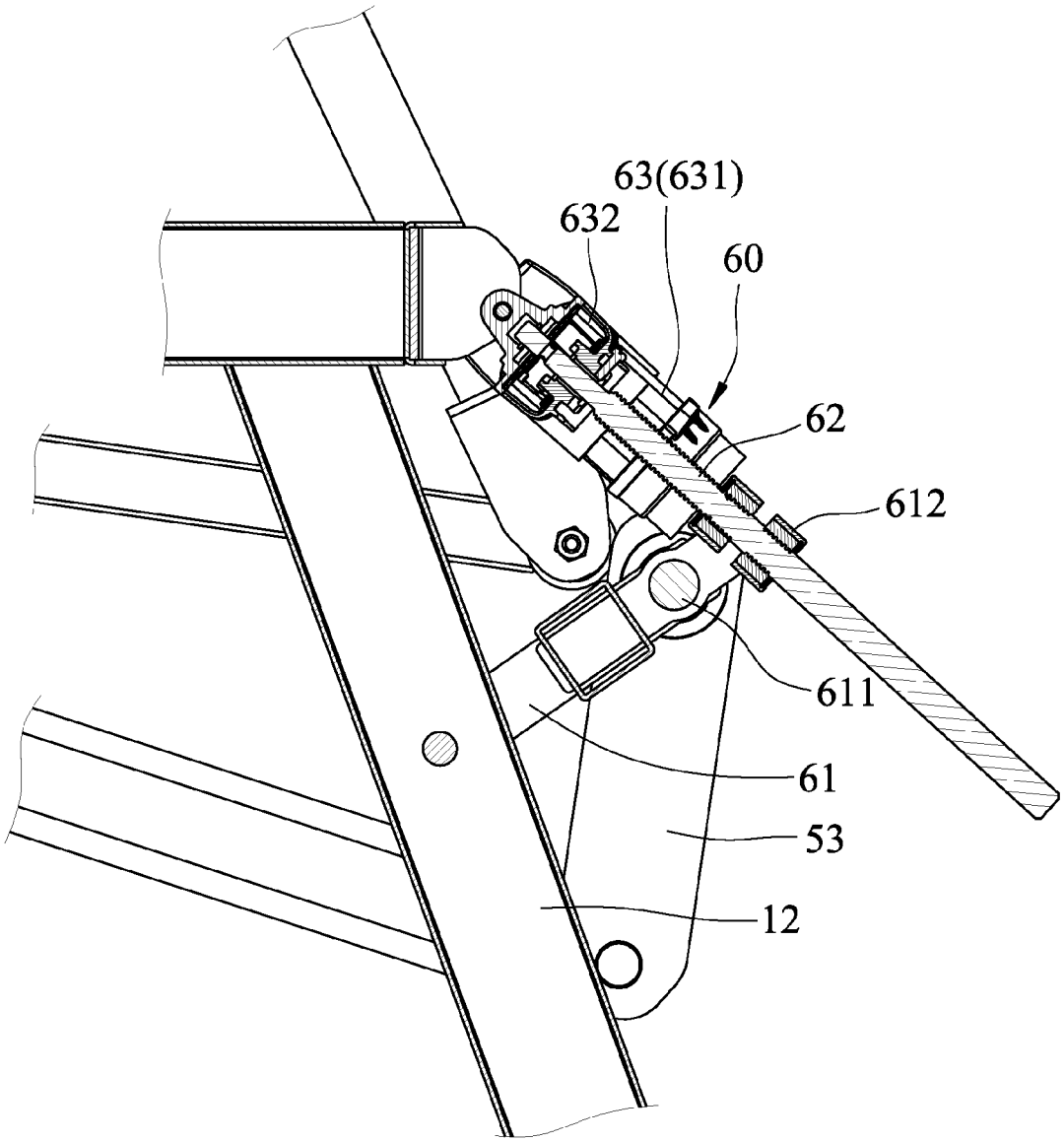
FIG. 4 is a schematic sectional view of a part of the climbing exercise machine with adjustable inclination in accordance with the present invention.

Referring also to FIG. 4, the adjusting unit 60 is mounted at the frame 10 and operable to move the constrained end portions 531 of the links 53 relative to the support 12 to further adjust the distance between the rear pivoting portions 522 of the rockers 52 and the base 11 of the frame 10. The adjusting unit 60 comprises an interlocking member 61 pivotally connected to a front side of the support 12 of the frame 10, a screw rod 62 threaded into the interlocking member 61, and a driving device 63 pivotally connected to the support 12 of the frame 10. The interlocking member 61 comprises a pivot axle 611 pivotally connected to the constrained end portions 531 of the links 53 of the guide unit 50, and a screw nut 612 pivotally connected to one side of the pivot axle 611 and threaded onto the screw rod 62. The driving device 63 is operable to rotate the screw rod 62 and to further bias the interlocking member 53, causing movement of the interlocking member 53 along the screw rod 62. In this embodiment, the driving device 63 comprises a servo motor 631, and a gearbox 632 adapted for transmitting the output power of the servo motor 631. The screw rod 62 is coupled to the output end of the gearbox 632. Starting up the servo motor 631 can drive the screw rod 62 to rotate, thereby causing the interlocking member 53 to rotate relative to the support 12 and to move along the screw rod 62.

The handlebar unit 70 comprises a pair of grips 71 respectively connected to the top ends of the arm members 21 above the transverse axle 131.

Referring to FIGS. 3 and 4 again, when a user uses the climbing exercise machine and imparts a pressure to the pedals 32 and the respective pedal shafts 31 horizontally and forwardly with the two legs alternatively, the front end portions 311 of the respective pedal shafts 31 are alternatively forced against the swinging portions 212 of the respective arm members 21, causing the respective arm members 21 to turn back and forth alternatively about the transverse axle 131 of the upright post 13 of the frame 1. At the same time, the rockers 52 are alternatively forced by the respective pedal shafts 31 to move the respective cranks 51, driving the rotatable wheel 41 to rotate. During rotation of the rotatable wheel 41, the damping wheel 42 is driven to rotate by the rotatable wheel 41, thereby generating a damping force and achieving the purpose of exercise.

Figure 5:
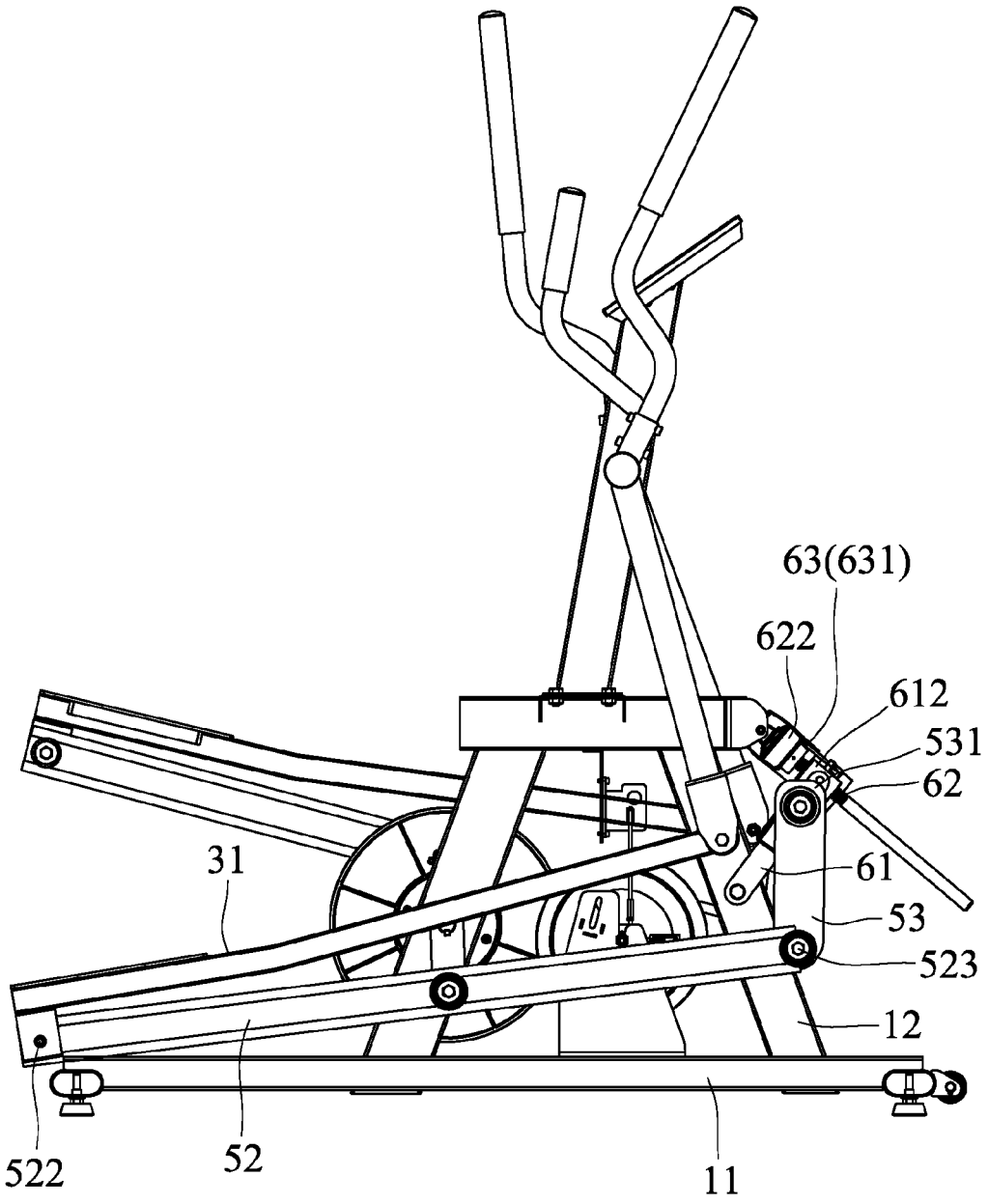
FIG. 5 is a schematic drawing illustrating an adjustment operation of the climbing exercise machine with adjustable inclination in accordance with the present invention.
Figure 6:
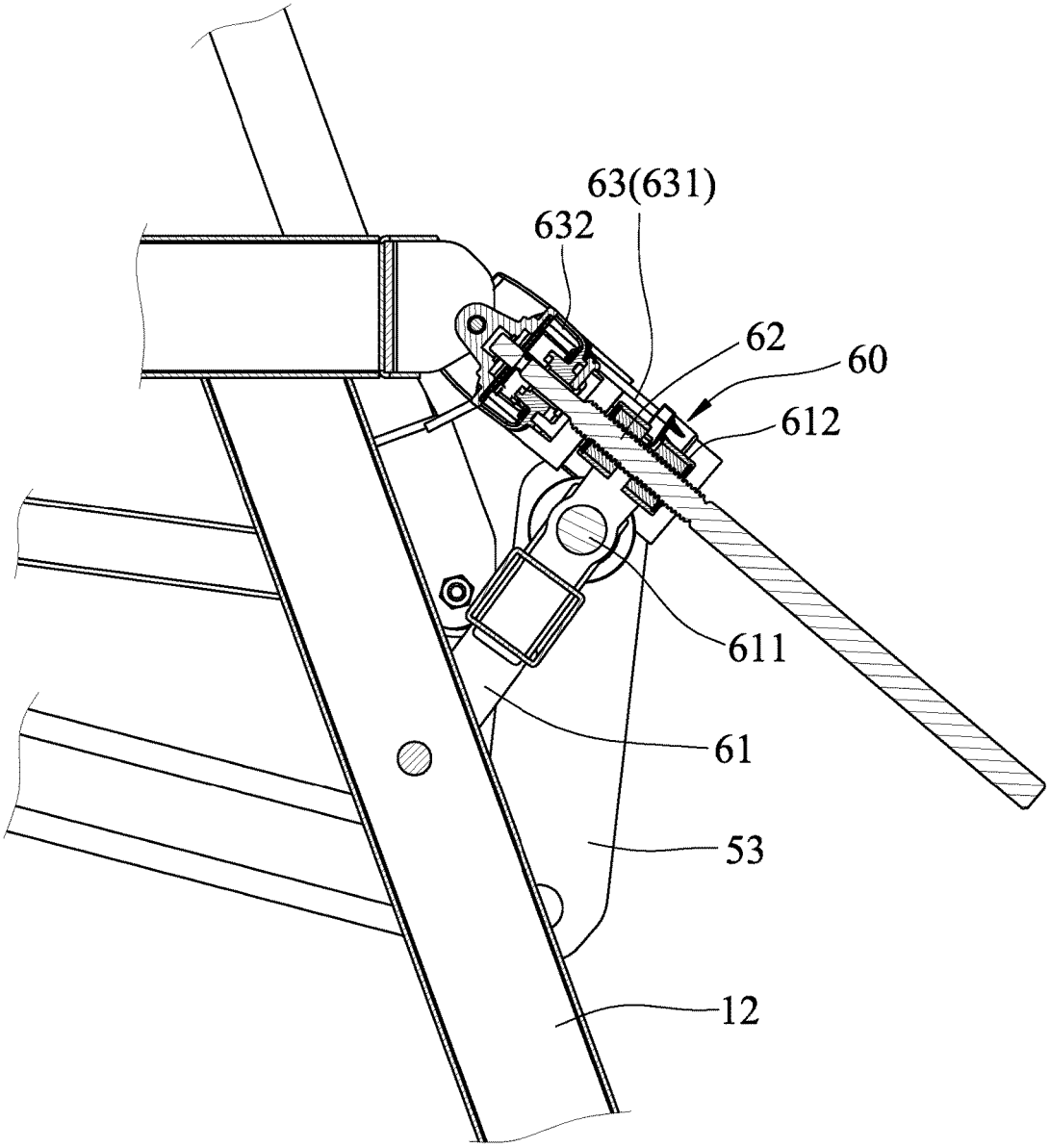
FIG. 6 is a schematic sectional view of the climbing exercise machine as adjusted.

Referring to FIGS. 5 and 6, when the user operates the servo motor 631 of the driving device 63 to rotate the screw rod 62 in one direction, the screw nut 612 is driven to move toward the gearbox 632, and the interlocking member 61 is driven to move the links 53. At this time, the constrained end portions 531 of the links 53 are moved relative to the support 12, and the elevation of the front pivoting portion 523 of each rocker 52 relative to the base 11 is changed, and thus, the distance between the rear pivoting portions 522 of each rocker 52 and the base 11 is adjusted, enabling the rockers 52 to move the respective pedal shafts 31 at a relatively steeper slope angle.

Conversely, when the user operates the servo motor 631 of the driving device 63 to rotate the screw rod 62 in the reversed direction, the screw nut 612 is driven to move away from the gearbox 632, the rockers 52 are allowed to move the respective pedal shafts 31 at a relatively smaller slope angle.

Thus, the invention uses the adjusting unit 60 to move the constrained end portions 531 of the links 53 relative to the support 12, achieving adjustment of the distance between the rear pivoting portions 522 of the rockers 52 and the base 11, and thus, the inclination of the pedal shafts 31 is relatively adjusted. The climbing exercise machine of the invention has a simple structure, and allows easy adjustment of the inclination in a stepless manner.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A climbing exercise machine, comprising:

a frame comprising a base and a support fixedly mounted at said base;

an exercising unit comprising a pair of arm members respectively pivotally mounted to said support of said frame and alternatively movable back and forth relative to said frame, each said arm member comprising a pivot-connection portion located at a top end thereof and pivotally connected to said support and a swinging portion located at an opposing bottom end thereof;

a pedal unit comprising a pair of pedal shafts respectively pivotally connected to said arm members of said exercising unit, each said arm member comprising a front end portion located at a front end thereof and pivotally connected to said swinging portion of a respective one of said arm members and a rear end portion located at an opposite end thereof;

a damper adapted for imparting damping to said pedal shafts, said damper comprising a rotatable wheel, said rotatable wheel comprising an axle pivotally connected to said frame;

a guide unit comprising a pair of cranks respectively fixedly connected to two opposite ends of said axle of said rotatable wheel and adapted for driving said rotatable wheel to rotate, a pair of rockers respectively pivotally connected to said cranks and a pair of links respectively pivotally connected to said rockers, each said rocker comprising a middle pivoting portion located at a middle part thereof and pivotally connected to a respective one of said cranks, a rear pivoting portion located at a rear end thereof and pivotally connected to said rear end portion of a respective one of said pedal shafts of said pedal unit and a front pivoting portion located at an opposing front end thereof and pivotally connected to a respective one of said links, each said link having one end thereof pivotally connected to said front pivoting portion of a respective one of said rockers and an opposite end thereof terminating in a constrained end portion; and an adjusting unit mounted at said frame and operable to move said constrained end portions of said links relative to said support to further adjust the distance between said rear pivoting portions of said rockers and said base.

2. The climbing exercise machine as claimed in claim 1, wherein said adjusting unit comprises an interlocking member pivotally connected to said support of said frame, a screw rod threaded into said interlocking member and a driving device pivotally connected to said support of said frame, said interlocking member comprising a pivot axle pivotally connected to said constrained end portions of said links of said guide unit and a screw nut pivotally connected to one side of said pivot axle and threaded onto said screw rod, said driving device being operable to rotate said screw rod and to further drive said interlocking member to rotate relative to said support and to move along said screw rod.

3. The climbing exercise machine as claimed in claim 2, further comprising a handlebar unit, said handlebar unit comprising a pair of grips respectively connected to the respective top ends of said arm members.

* * * * *